United States Patent [19]

Guzowski et al.

[11] Patent Number: 4,990,822

[45] Date of Patent: Feb. 5, 1991

[54] FOCUSING ELECTRODE ASSEMBLY FOR A COLOR CATHODE RAY TUBE ELECTRON GUN

[75] Inventors: Kenneth A. Guzowski, Hoffman Estates; Andrew C. Derr, Western Springs, both of Ill.

[73] Assignee: Zenith Electronics Corporation, Glenview, Ill.

[21] Appl. No.: 459,033

[22] Filed: Dec. 29, 1989

[51] Int. Cl.[5] ..... H01J 29/51

[52] U.S. Cl. ..... 313/414; 313/409; 313/412; 313/417; 313/421

[58] Field of Search ..... 313/412, 414, 409, 421, 313/417

[56] References Cited

U.S. PATENT DOCUMENTS 4,181,870 1/1980 Stevens ..... 313/414
4,678,964 7/1987 Peels ..... 313/414
4,737,682 4/1988 Alig et al. ..... 313/414

FOREIGN PATENT DOCUMENTS 0064740 4/1983 Japan ..... 313/414

*Primary Examiner*—Donald J. Yusko
*Assistant Examiner*—Ashok Patel

[57] ABSTRACT

A three-beam unitized, in-line electron gun for a color cathode ray tube has a series of hollow, rectangulr-in-cross-section electrodes for the side-by-side accommodation of the three beams. A two-element anode electrode for the gun includes first and second cup-shaped elements each having an apertured electrode face. The second cup-shaped element is nested in the first element, and has a cup draw effective to provide a predetermined distance between the electrode faces when the cups are in nested relationship. The critical focusing and convergence of the gun can thereby be adjusted by the adjustment of the cup draw.

17 Claims, 2 Drawing Sheets

FOCUSING ELECTRODE ASSEMBLY FOR A COLOR CATHODE RAY TUBE ELECTRON GUN

BACKGROUND OF THE INVENTION

Field of the Invention

This invention relates to color cathode ray picture tubes, and is addressed specifically to an improved electrode assembly for an electron gun for such tubes. This invention has applicability to electron guns of many types and constructions, but is believed to be most advantageously applicable to three-beam unitized guns for color television cathode ray tubes.

In the unitized electron gun, common structures are used for gun parts, resulting in economies in manufacture and simplification of structure. The gun generates three electron beams by cathodic thermionic emission. The resulting beams are formed and spaced by a tandem succession of electrodes spaced along the central axis of the gun. The electrodes cause the beams to be focused on multiple phosphor groups located on the faceplate of the tube that contains the gun.

The three electron beams of an in-line gun lie side-by-side in the same plane. The inner beam, which normally activates the green-light-emitting phosphor deposits, proceeds on a straight line path down the center axis of the gun and through the gun toward its landing point on the phosphor-bearing faceplate of the cathode ray tube. The two outer beams, which activate the red-light-emitting and blue-light-emitting deposits, travel through the electrodes in paths generally parallel to the inner beam, then are diverted near the end of the gun to provide convergence of the three beams on the faceplate.

Recent developments in cathode ray tube design have led to an electron gun that employs an "open" main lens that provides the benefits of a reduction in spherical aberration and size of the beam "spots" that fall on the screen. A gun of this type is termed the COTY (combined optimum tube and yoke) gun. It utilizes a bipotential main focus lens comprising a pair of complementary electrodes each having a respective, common lens in adjacent, facing relationship.

The first component of the main focus lens, referred to as G3 in the succession of electrodes in the gun, has the form of an elongated "racetrack" shaped aperture. The second component, known as G4, or the anode electrode, has a beam-passing aperture in the form of a "dog-bone," which comprises a single aperture slightly enlarged at both ends through which the three electron beams travel.

The G4 electrode in a prior COTY gun is formed in three sections consisting first of a cup-shaped element that faces G3, and which has a dog-bone aperture. There is a second element, also cup-shaped, with the openings of the two cups in facing relationship. An apertured, plate-like electrode is sandwiched between the two electrodes; this electrode functions as a "carrier" in that it has extending claws that are embedded in the two opposed glass beads, or multiforms, that hold all the gun electrodes in permanent, fixed alignment and spacing. The convergence cup of the COTY gun is fastened to the bottom, or closed section, of the second cup-like second electrode.

Problems inherent in the G4 assembly of the COTY gun, which are obviated by the present invention, include difficulty in aligning the apertures of the three electrodes and welding the electrodes together, attaining proper spacing and planarity of opposing faces, and difficulty in attaching the convergence cup to the second electrode.

OBJECTS OF THE INVENTION

It is a general object of this invention to provide an improved three-beam, unitized electron gun for a color television cathode ray tube.

It is an object of the invention to provide a unitized gun having an improved focusing electrode assembly.

It is another object of the invention to provide an electrode assembly offering improved tolerances and a more precise planarity of related electrode faces.

It is yet another object of the invention to provide an gun electrode assembly that provides for greater accuracy in the attachment of the convergence cup.

It is a further object to provide an electron gun anode electrode in which focusing and convergence can be adjusted by a relatively minor modification in the shape of an electrode element.

It is a further object of the invention to provide an electrode assembly for a COTY gun offering a simplified design with consequent economies in manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

FIG. 6 is a section of the view of FIG. 5 taken along sight-line 5—5, while FIG. 9 is a section of the view of FIG. 8 taken along sight line 8—8, while

DESCRIPTION OF THE PREFERRED EMBODIMENT

Figure 1:
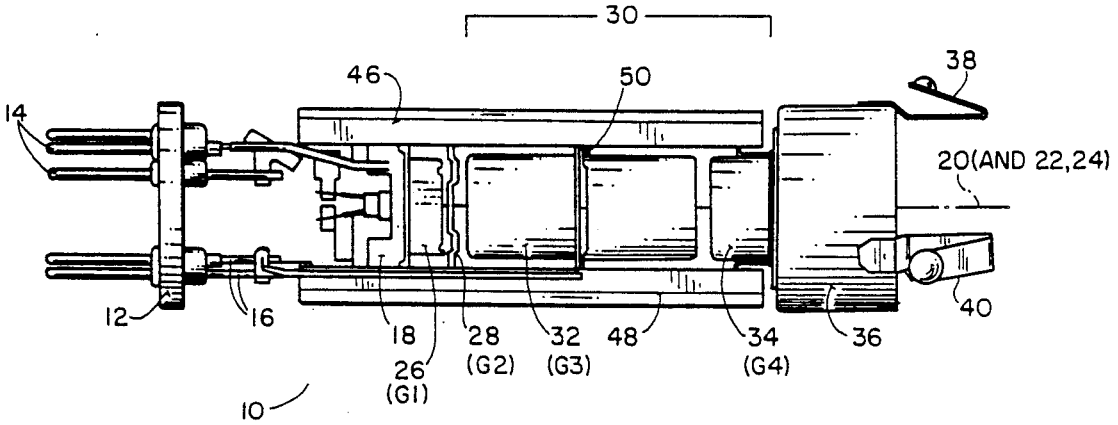
FIG. 1 is a side view in elevation showing schematically the components of an electron gun having an improved anode electrode according to the invention.

FIG. 1 is an assembled view of a unitized, in-line type of electron gun 10 for use in a color television cathode ray tube. With reference also to the perspective view of FIG. 2, electron gun 10 is depicted as having a series of hollow, rectangular-in-cross-section electrodes for the side-by-side accommodation of three electron beams. As is well-known in the art, such a gun structure for a cathode ray tube is located at the base of the cathode ray tube in the narrow neck region opposite the faceplate.

Gun 10 is illustrated as having a base 12 through which pass a plurality of lead-in pins 14 for introducing into the glass glass envelope of the tube the video signals as well as certain voltages for beam forming and focusing. The operating signals and voltages are conveyed to the several electrodes of gun 10 within the glass envelope by several electrode leads 16. Electron-emitting cathodes of a heater-cathode assembly 18 generate three coplanar beams of electrons 20, 22, and 24 which travel through the series of focusing electrodes indicated and through the convergence cup to energize the red, green and blue phosphor deposits, located on the imaging surface of the tube faceplate through a multi-apertured color selection electrode, or "shadow mask" (not shown).

A control electrode 26 (G1) is followed by an accelerating electrode 28 (G2). The beams then enter the electrostatic fields of the main focusing lens 30, indicated as comprising two unitized electrodes, electrode 32 (G3) and electrode 34 (G4). Each electrode of the main focusing lens 30 carries a predetermined, constant voltage. The difference in potential between adjacent electrodes 32 and 34 establishes a series of focusing field components, or "electrostatic lenses" capable of shaping of beam of electrons flowing through the field components, according to the principles of electron optics.

The last of the series of elements that comprise electron gun 10 is the convergence cup 36. Convergence cup 36 provides a mounting base for the contact springs 38 and 40 (a third contact spring is not shown) which hold the forward end of gun 10 firmly centered in the neck of the tube. Circular shunt magnets 42 and 44, which exert a converging effect on the respective outer beams 20 and 24, are indicated as being located inside the convergence cup.

Electrode 34 is the last focus electrode and is termed the "anode electrode" because it receives the high anode voltage of the cathode ray tube, a voltage in the range of 20 to 30 kilovolts, with the potential depending upon tube size. Through contact with the electrically conductive coating located on the inside of the adjacent funnel (not shown) the three contact springs conduct the high anode voltage to electrode 34. The electrode 34 shown may comprise the anode electrode of a combined optimum tube and yoke (COTY)-type gun.

The electrodes of gun 10 are held rigidly in mutual relationship by the two insulative glass beads 46 and 48. In the assembly process, the electrodes are stacked on mandrels which pass through the apertures; spacers placed between the electrodes provide for specified gaps between the electrodes. The claws of each electrode, which comprise extensions of the metal of the electrodes, are then embedded in the beads 46 and 48 when the glass of the beads is in a semi-molten state. The claws 50 extending from electrode 32 are typical of such claws.

Figure 2:
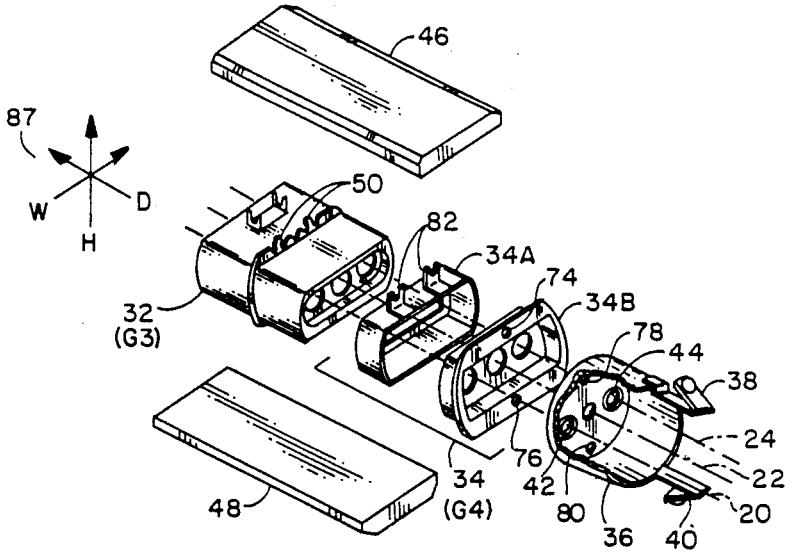
FIG. 2 is an exploded view in perspective of an anode electrode according to the invention in relation to the associated focusing electrode and convergence cup.
Figure 4:
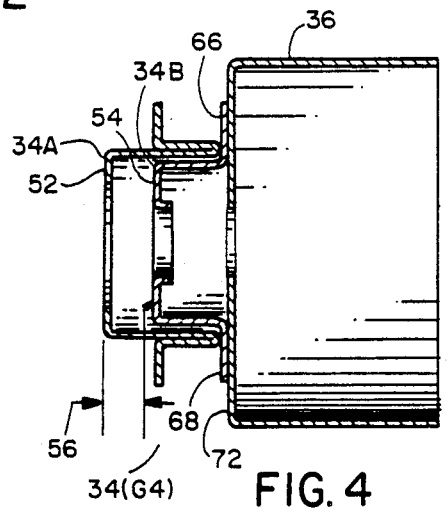
FIG. 4 is a sectional view of the anode electrode assembly of FIG. 3 taken along sight-line 3—3 of FIG. 3, showing the interrelationship of the two electrodes comprising the anode electrode; a convergence cup is shown as being attached.
Figure 5:
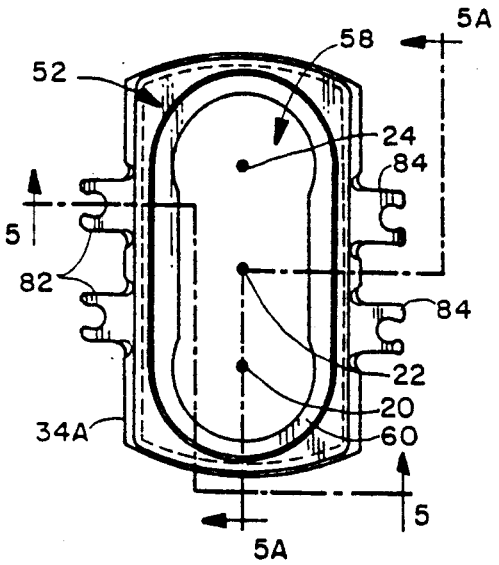
FIG. 5 is a plan view of the end of the anode electrode that faces the cathode end of the gun.

Electrode 34 is indicated by the bracket in FIG. 2 as comprising two cup-shaped elements 34A and 34B. First cup-shaped element 34A is indicated in FIG. 5 as having an apertured electrode face 52 with a single aperture therein. Second cup-shaped element 34B is also indicated as having an apertured electrode face 54, but with three apertures therein, one for each of the three beams 20, 22 and 24 (depicted additionally in FIGS. 8 and 10). Second cup-shaped element 34B is shown in FIG. 4 as being nested into first element 34A. Second element 34B has, according to the invention, a cup draw effective to provide a predetermined distance between the respective electrode faces 52 and 54 of first and second elements 34A and 34B when in the nested relationship indicated by FIGS. 1 and 4. The critical focusing and convergence of the beams 20, 22 and 24 of gun 10 can be adjusted thereby according to the invention by the adjustment of the cup draw.

The "cups" comprising the electrodes are formed by a drawing operation, in which a die punch pushes sheet metal into a female die. Die-forming offers economies in manufacture, along with an ability to form parts meeting close tolerance requirements. Electrode cups are known as "deep draws" because of the great depth of the draw; to achieve the proper depth, drawing is accomplished in a progressive operation using successive die sets, each of which further deepens the draw. Bright annealed stainless steel of the austenitic family, AISI type 305, is preferred as an electrode material in that it offers excellent corrosion resistance, high strength, and tolerance to the high temperatures experienced in processing cathode ray tubes. Also, type AISI 305 is essentially non-magnetic and does not harden under heat treatment.

Figure 9:
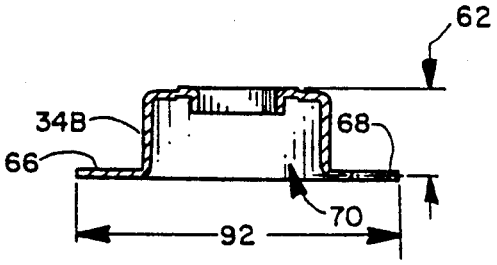

The draw of cup-shaped element 34B is indicated by reference No. 62 shown by FIG. 9; the amount of draw is about 0.175 inch. The resulting distance between electrode face 52 of element 34A and electrode face 54 of element 34B, indicated by reference No. 56 in FIG. 4, is nominally 0.115 inch. A change of ±0.001 inch in distance 56 will result in a free-fall change of ±0.006 inch on the screen of the tube; that is, a change in spacing between the beam spots landing on the screen.

The need for adjusting the distance between electrode faces 52 and 54 is related to the shape of the electrode face of element 34A. With reference to FIG. 5, electrode face 52 of element 34A is shown as comprising a single, horizontally elongated aperture 58 for passing the three beams 20, 22 and 24. Aperture 58 will be seen as having the general shape of a "dog bone," with the two outer beams 20 and 24 passing through the expanded ends of the aperture 58, and the center beam 22 passing through the narrower, central area of aperture 58. The hachure lines around aperture 58 indicate a plateau 60 that is 0.0015 inch in height.

The contour of dog-bone aperture 58 exerts a substantial influence on the focusing and convergence of the three beams 20, 22 and 24 passing therethrough. Even minor changes in the shape and dimensions of the aperture will have a great influence on the beams. And any changes in aperture shape and/or dimensions will be expensive in terms of redesign and retooling costs.

It was found that beam focusing and convergence is strongly influenced by the magnitude of the aforedescribed predetermined distance 56 between the respective faces 52 and 54 of elements 34A and 34B, a distance dependent upon the cup draw 62 of element 34B. The depth of the draw can be changed by as much as ±0.003 inch to achieve the desired beam focusing and convergence before it is necessary to change the contour of the dog-bone aperture 58 of element 34A.

Figure 3:
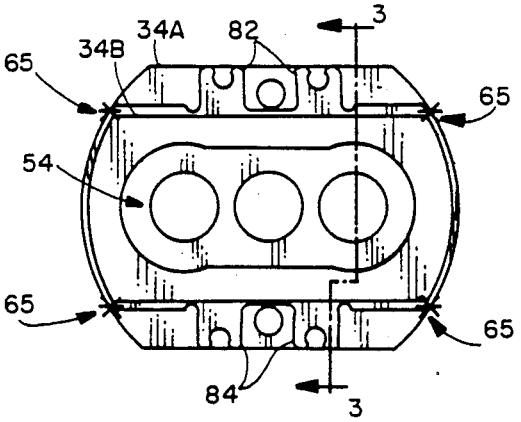
FIG. 3 is plan view of the anode electrode assembly according to the invention as seen from the screen end of the tube.

The electrode elements are fastened together by a process known as T.I.G. welding. "T.I.G." stands for "tungsten inert gas"; the arc takes place in an inert shielding gas. A welding electrode is brought close to the parts to be joined, such as two mating flanges, and the arc that results in jumping to the gun parts generates a controlled melting in a very small area of each of the parts that constitutes an effective weld. T .I. G. welds used to weld gun elements 34A and 34B together are indicated, by way of example, by the weld symbols 65 (*) in FIG. 3.

Figure 8:
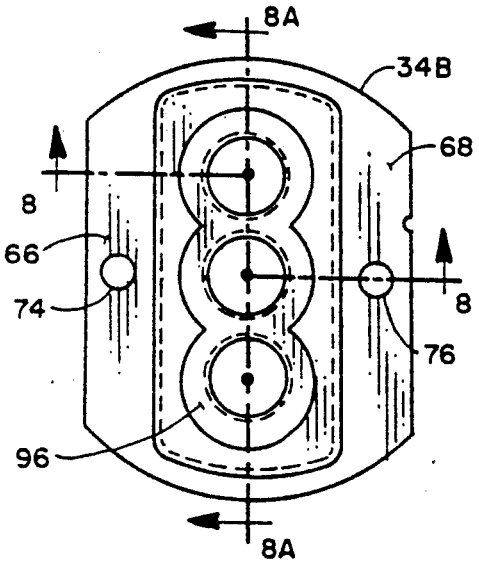

With reference to FIGS. 4, 8 and 9, element 34B will be noted as having flange means 66 and 68 extending outwardly from its open end 70 (shown by FIG. 10) for attachment to the rear face 72 of convergence cup 36. Each flange means 66 and 68 will be noted as having respective holes 74 and 76 which provide for conjoining with corresponding holes 78 and 80 co-located in the rear wall 72 of convergence cup 36 (shown by FIG. 2). Precision joindure of element 34B and convergence cup 36 is achieved by means of tooling pins (not indicated) passed through the holes, after which the two parts are joined by T.I.G. welding.

Element 34A will be noted as having claws 82 and 84 formed integrally from the material of the element, and extending transversely to the plane of beams 20, 22 and 24 for engagement with the two glass beads 46 and 48 located on opposed sides of gun 10.

Figure 7:
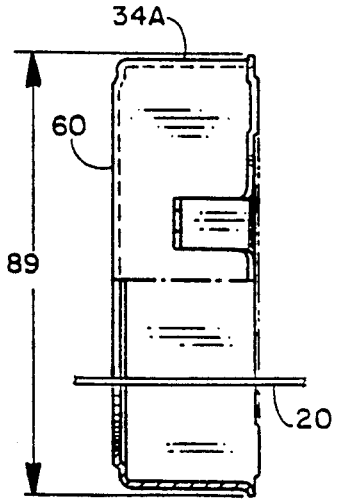
FIG. 7 is a section of FIG. 5 taken along sight line 5A—5A; and, FIG. 8 is a plan view of the end of the anode electrode assembly that attaches to the convergence cup.
Figure 6:
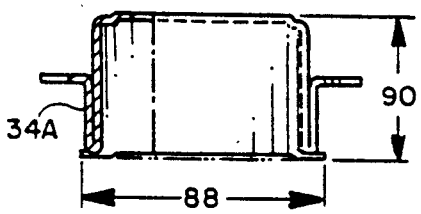

The general dimensions of the electrode elements are described as follows, as viewed from the aspect of FIG. 2 (please note the explanatory ("HWD" diagram 87). Element 34A, as depicted in FIGS. 5, 6 and 7, has a height 88 of 0.480 inch, a width 89 of 0.875 inch, and a depth 90 of 0.275 inch. The claws 82 and 84 extend 0.110 inch from the body of the element (as viewed from section 5A—5A of FIG. 5).

Figure 10:
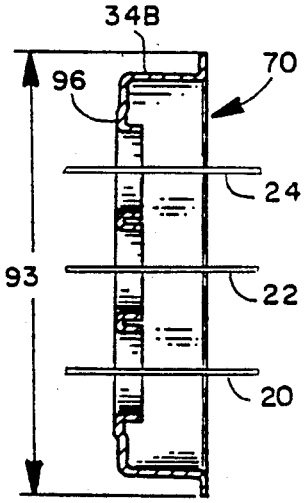
FIG. 10 is a section of FIG. 8 taken along sight line 8A—8A.

Element 34B, as depicted in FIGS. 8, 9 and 10, has in inch measure a height 92 of 0.660 inch, a width 93 of 0.875 inch, and a depth 62 (as previously described) of 0.175 inch. The plateaus 60 and 96, indicated by the hachure marks in FIGS. 5 and 8, and in FIGS. 7 and 10, rise 0.0015 inch above the face of each element 34A and 34B. The depth of the two elements when cupped together is 0.290 inch.

The benefits obtained by the two-element electrode according to the invention, and as described in the foregoing, include:

1. A reduction in the number of anode electrode parts in COTY-type guns from three to two.
2. Fewer precision tolerances needed.
3. Easier and more precise location of the convergence cup.
4. Easier achievement of optimum planarity of the electrode faces 52 and 54 of respective elements 34A and 34B.
5. Depth of the draw of element 34B can be changed to change beam focusing and convergence without the need to alter the contour of the dog-bone aperture 58 of element 34A.

Further with regard to item 5, in a regular in-line gun such as, by way of example, a COTY-type gun with a dog-bone aperture can normally be used with only one tube size. This limitation is attributable to the combined conditions of throw distance, which is defined as the distance from the end of the gun to the center of the phosphor coating plane, and the free-fall convergence, which is defined as the measuring of the location landings of the two outer beams.

This invention makes it possible to use an electrode having a standard dog-bone aperture in tubes of different diagonal dimensions. All that is necessary is to readjust the spacing between planes of electrode faces 52 and 54; redesign and/or retooling of the dog-bone is not required.

When the two-element electrode is used in a gun with dynamic astigmatism control, change in the astigmatism of the gun, which accompanies the readjusting of spacing of electrode faces 52 and 54 of electrodes 34A and 34B can be properly compensated for by a minor adjustment of the voltage bias of electrode 34.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. For use in a color cathode ray tube having a three-beam unitized, in-line electron gun, said gun having a series of hollow, rectangular-in-cross-section electrodes for the side-by-side accommodation of the three beams, a two-element electrode for said gun, comprising:

a first cup-shaped element having an aperture electrode face; and a second cup-shaped element having an apertured electrode face, said second cup-shaped element nested into said first cup-shaped element and having a cup draw effective to provide a predetermined distance between the faces of said first cup-shaped element and said second cup-shaped element when in nested relationship, whereby critical focusing and convergence of said gun can be adjusted by adjustment of said cup draw.

2. The two-element electrode of claim 1 wherein said second cup-shaped element has flange means extending outwardly from its open end for attachment to the rear face of a convergence cup.

3. The two-element electrode of claim 2 wherein said flange means has holes for receiving locating-tool means passed through corresponding holes in said convergence cup.

4. The two-element electrode of claim 3 wherein said holes are two in number.

5. The two-element electrode of claim 1 wherein said first cup-shaped element has claws extending tranversely to the plane of said beams for engagement with two glass beads located on opposed sides of said gun.

6. The two-element electrode of claim 5 wherein said claws extending from said first cup-shaped element are formed integrally from the material of the element.

7. The two-element electrode of claim 1 wherein said aperture electrode face of said second cup-shaped element has three circular apertures therein.

8. The two-element electrode of claim 1 wherein said two-element electrode is the an anode electrode of said in-line electron gun and is coupled to an anode voltage source.

9. The two-element electrode of claim 1 wherein said two-element electrode is the anode electrode of a combined optimum tube and yoke (COTY)-type gun.

10. The two-element gun of claim 1 wherein said apertured electrode face of said first cup-shaped element comprises a single, horizontally elongated aperture for receiving said three beams, said horizontally located aperture having the general shape of a dog bone, with the two outer beams passing through the expanded ends of said aperture, and the center beam passing through the narrower, central area of said aperture.

11. For use in a color cathode ray tube having a three-beam unitized, in-line electron gun, said gun having a series of hollow, rectangular-in-cross-section electrodes for the side-by-side accommodation of the three beams, a two-element electrode for said gun, comprising:

a first cup-shaped element having an electrode face with a single, horizontally elongated aperture for receiving said three beams, said horizontally elongated aperture having the general shape of a dog bone, with the two outer beams passing through the expanded ends of said horizontally elongated aperture, and center beam passing through the narrower, central area of said horizontally elongated aperture; and a second cup-shaped element having an aperture electrode face, said second cup-shaped element nested into said first cup-shaped element and having a cup draw effective to provide a predetermined distance between the faces of said first cup-shaped element and said second cup-shaped element when in nested relationship, whereby the critical focusing and convergence of said gun can be adjusted by the adjustment of said cup draw.

12. For use in a color cathode ray tube having a three-beam unitized, in-line electron gun, said gun having a series of hollow, rectangular-in-cross-section electrodes for the side-by-side accommodation of the three beams, a two-element anode electrode coupled to an anode voltage for said gun, comprising:

a first cup-shaped element having an electrode face with a single, horizontally elongated aperture for receiving said three beams, said horizontally elongated aperture element having general shape of a dog bone, with two outer beams passing through expanded ends of said horizontally elongated aperture, and center beam passing through narrower, central area of said horizontally elongated aperture; and a second cup-shaped element having an apertured electrode face with three circular apertures therein, and having flange means extending outwardly from its open end for attachment to rear face of a convergence cup, said second cup-shaped element nested into said first cup-shaped element and having a cup draw effective to provide a predetermined distance between the faces of said first cup-shaped element and said second cup-shaped element when in nested relationship, whereby critical focusing and convergence of said gun can be adjusted by adjustment of said cup draw.

13. The two-element anode electrode of claim 12 wherein said flange means of said second cup-shaped element has holes for receiving locating-tool means passed through corresponding holes in said convergence cup.

14. The two-element anode electrode of claim 13 wherein said holes are two in number.

15. The two-element anode electrode of claim 12 wherein said first element has claws extending transversely to the plane of said beams for engagement with two glass beads located on opposed sides of said gun.

16. The two-element anode electrode of claim 15 wherein said claws extending from said first element are formed integrally from the material of the electrode.

17. The two-element anode electrode of claim 12 wherein said electrode is the anode electrode of a combined optimum tube and yoke (COTY)-type gun.

* * * * *